US005627426A

United States Patent [19]

Whitman et al.

[11] Patent Number: 5,627,426

[45] Date of Patent: May 6, 1997

[54] LAMP WITH IR REFLECTING FILM AND LIGHT-SCATTERING COATING

[75] Inventors: Pamela K. Whitman; Thomas G. Parham, both of Gates Mills; Thomas M. Sharda, Willoughby, all of Ohio

[73] Assignee: General Electric Company, Schenectady, N.Y.

[21] Appl. No.: 513,564

[22] Filed: Mar. 22, 1993

[51] Int. Cl.[6] ..... H01J 5/16; H01K 1/32

[52] U.S. Cl. ..... 313/116; 313/112; 252/584; 359/599; 359/586

[58] Field of Search ..... 313/110, 112, 313/113, 116, 580, 635; 252/587, 584; 362/293; 359/359, 599, 586

[56] References Cited

U.S. PATENT DOCUMENTS 4,171,227 10/1979 Derolf et al. ..... 106/85
4,663,557 5/1987 Martin, Jr. et al. ..... 313/112
4,721,877 1/1988 Kawakatsu et al. ..... 313/580
5,410,212 4/1995 Reisman ..... 313/116
5,412,274 5/1995 Parham ..... 313/112

*Primary Examiner*—Michael Horabik
*Assistant Examiner*—Michael Day
*Attorney, Agent, or Firm*—George E. Hawranko

[57] ABSTRACT

Incandescent lamps or arc lamps having an infrared red reflecting multilayer optical interference filter on the outer surface of the vitreous or fused quartz lamp envelope enclosing the filament have a light-scattering coating applied over the filter to scatter light emitted by the lamp and thereby diffuse the filament image. The light-scattering coating consists of light-scattering particles, such as alumina, dispersed in a silica matrix. This coating is formed by applying to the filter a silicone solution in which is dispersed colloidal silica and light-scattering particles and pyrolyzing at high temperature to drive off the organic components and form the silica matrix.

18 Claims, 2 Drawing Sheets

Fig. 1(a)
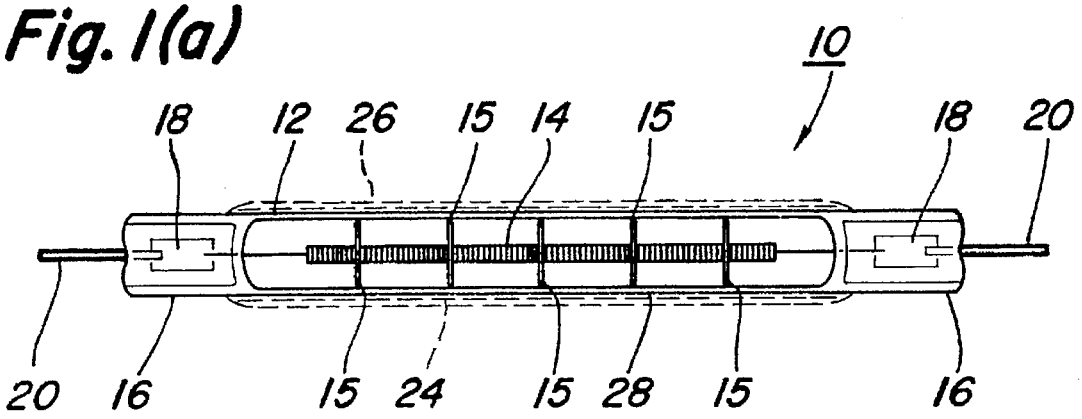
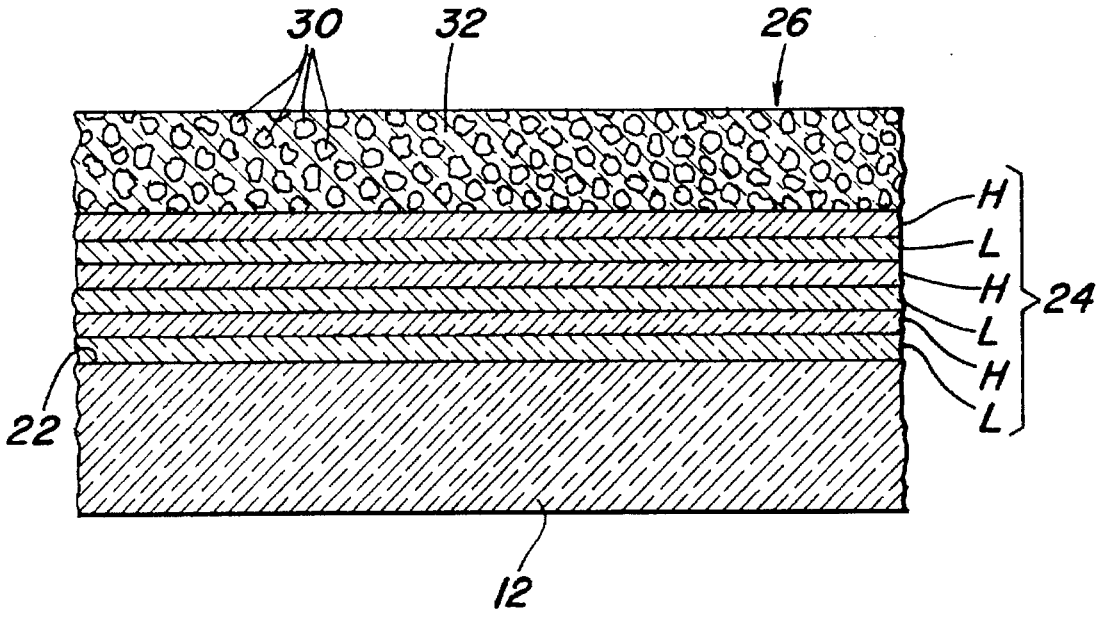
Fig. 1(b)

LAMP WITH IR REFLECTING FILM AND LIGHT-SCATTERING COATING

BACKGROUND OF THE INVENTION

1. Field of the Invention

This invention relates to an electric lamp having an infrared reflecting filter and a light-scattering coating. More particularly, this invention relates to a lamp comprising a light-transmissive envelope enclosing an electric source of light with an infrared reflecting filter on the envelope and a light-scattering coating disposed adjacent the filter, wherein the coating contains light-scattering particles dispersed in a silica-containing, glassy binder.

2. Background of the Disclosure

Electric lamps employing a filament or arc as the source of light emit light in a pattern in which the light source is visible, unless the emitted light is broken up. Means commonly employed to break up a light source image include a lenticuled lens (with or without the use of a reflector), sandblasting the lamp envelope, etching the lamp envelope or coating the lamp envelope to scatter the emitted light and diffuse the light source image of the arc or filament. Acid etching or coating the lamp envelope is most commonly found in a conventional household type of incandescent lamp wherein the glass envelope enclosing the filament is acid etched (frosted) and/or coated with a particulate, light-diffusing material. A mixture of clay and silica or titanium dioxide is often used as the particulate, light-scattering material, because of its availability, light-scattering properties, chemical inertness and ability to withstand the high temperatures reached during lamp operation.

High intensity incandescent lamps used for stage and studio lighting employ a fused quartz filament or arc chamber and are sometimes sand-blasted to break up the emitted light source image so that the light emitted by the lamp is more diffuse and the light source is not visible on the object(s) being illuminated. The fused quartz is able to withstand the extremely high temperatures often exceeding 900° C. reached during lamp operation.

More recently high intensity lamps have been developed having multilayer optical interference filters disposed on the outer surface of the vitreous lamp envelope containing the light source within. These filters are multilayer films or coatings which are designed to transmit visible light radiation, but reflect emitted infrared radiation (IR) back to the filament light source. The reflected IR radiation increases lamp efficacy by reducing the amount of electrical energy needed to maintain the desired filament temperature. Since the amount of visible light radiation is the same but the amount of electricity required to produce this radiation is reduced, the efficacy or visible light output per unit of electrical energy or lumens per watt (LPW), is increased. However, an infrared reflecting, multilayer optical interference filter cannot be applied to a rough surface, such as a light-scattering sand-blasted surface, because it won't be able to reflect infrared radiation emitted by the light source back to the light source. In order for such a filter to be useful the light source must have its optical axis aligned coincident with the optical axis of a lamp envelope whose surface is smooth and concentric about the light source, so that the filter reflects the emitted infrared radiation back to the light source, such as a filament. A rough surface will destroy the ability of the filter to reflect the emitted infrared radiation back to the filament or arc, thereby rendering it useless. If the surface roughness of the lamp envelope is large with respect to the wavelength of IR radiation (i.e., 4 microns), the IR is coherently reflected in a diffuse manner and misses the filament. If the roughness is on a scale of about 0.4–2 microns, then the coherent reflection is disrupted and the filter no longer reflects the IR since it is no longer a quarter wave filter. Thus, a need exists for a lamp having a filter which transmits visible light radiation but reflects infrared light radiation back to the light source and wherein the emitted light is broken up or scattered to diffuse the light source image making it less discernible.

SUMMARY OF THE INVENTION

The present invention relates to a lamp comprising a light-transmissive envelope enclosing a source of infrared radiation (IR) and visible light radiation with a multilayer optical interference filter disposed adjacent said envelope which transmits visible light and reflects infrared radiation back to said source, and a light-scattering coating comprising light-scattering particles in a vitreous, silica binder disposed adjacent the filter. By visible light is meant light radiation broadly ranging between 380 to 770 nm and preferably 400 to 750 nm. The coating scatters the visible light emitted by the source, thereby diffusing the light source image in the light emitted by the lamp. The light source may be either an arc discharge or a filament and, in one embodiment, the lamp will comprise a vitreous, light-transmissive envelope enclosing a light source and having a multilayer optical interference filter disposed on the surface of the envelope with the light-scattering coating disposed adjacent the filter. The coating is formed by dispersing particles of suitable light-scattering material in a liquid binder comprising a dispersion of colloidal silica in a silicone. The liquid dispersion is then sprayed or dipped onto the filter, dried and heated to elevated temperature to drive out the organic material and form a coating comprising light-scattering particles in a vitreous or glassy binder comprising silica.

High intensity stage and studio incandescent lamps have been made according to the invention comprising a vitreous, light-transmissive fused quartz envelope hermetically sealed and enclosing a tungsten filament and halogen within, with an infrared reflecting and visible light transmitting multilayer optical interference filter on the surface of the envelope and a light-scattering coating disposed over the filter. In another embodiment, the multilayer optical interference filter can be used to control the color of the light emitted by the lamp by selectively transmitting only certain portions of the visible light spectrum. In this embodiment it is up to the. practitioner as to whether or not the filter will also reflect IR radiation back to the light source. In yet other embodiments the combination of optical interference filter and light-scattering coating may be employed on a reflecting surface or on a lens. In its broadest sense therefore, the invention relates to a light-transmissive article having at least one surface with at least a portion of said surface having a multilayer optical interference filter on which is disposed a light-scattering coating according to the invention.

BRIEF DESCRIPTION OF THE DRAWINGS

FIGS. 1(*a*) and 1(*b*) schematically illustrate an incandescent lamp having an optical interference filter and light-scattering coating on the outer surface of the lamp envelope and a detail of the coating and filter on the lamp surface.

DETAILED DESCRIPTION

Figure 2:
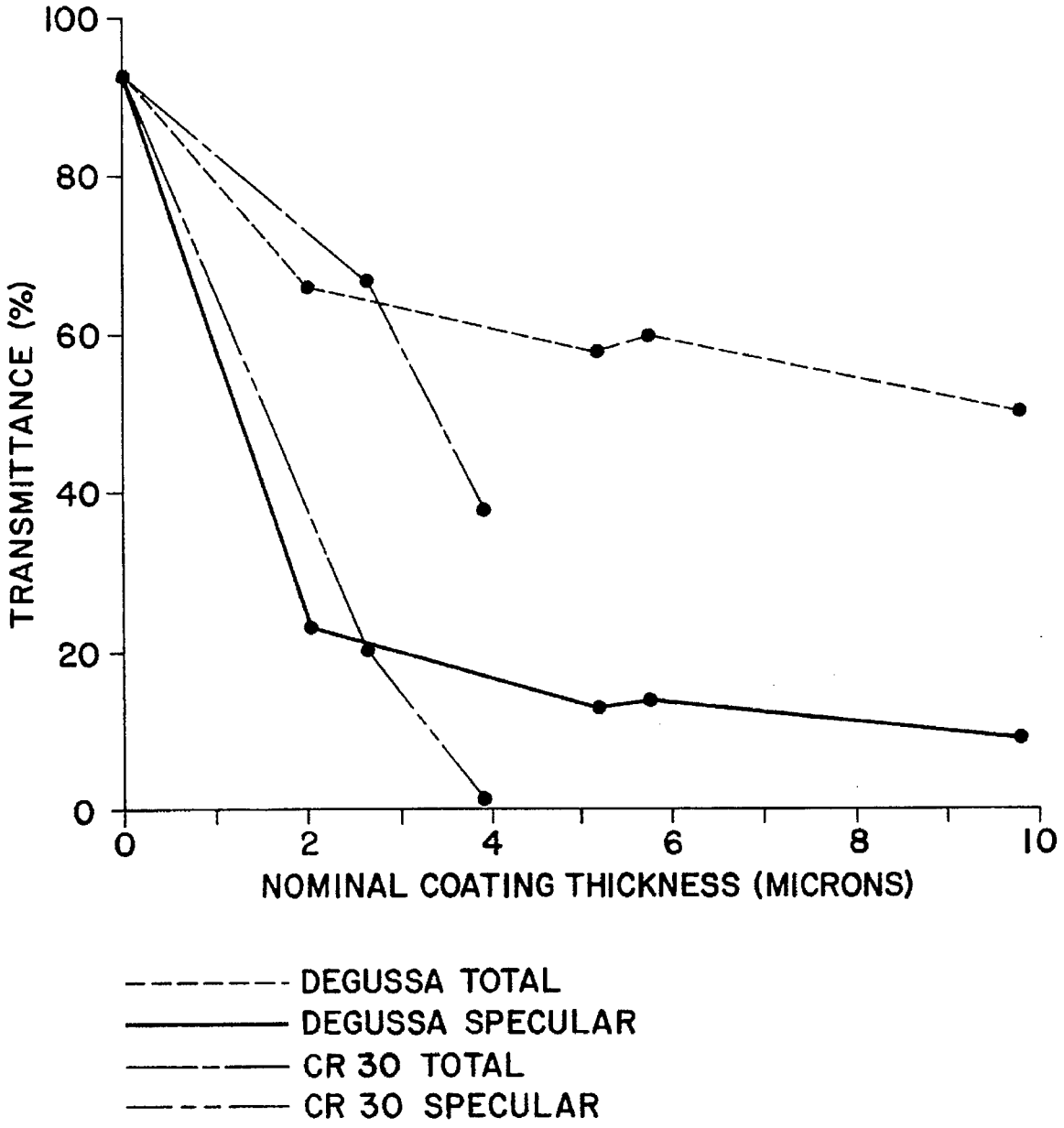
FIG. 2 is a graph of percent transmittance of a lamp as a function of the amount of light-scattering coating disposed on the optical interference filter.

Referring to FIG. 1(*a*), linear, incandescent lamp 10 is shown comprising visible light-transparent fused quartz lamp envelope 12 having a filament 14 hermetically sealed within and supported in the envelope by means of five filament supports 15. The lamp is hermetically sealed at both ends by a customary pinch seal 16 over molybdenum sealing foils 18 with inleads 20 extending out through the pinch seal portions to provide electricity to filament 14 through molybdenum foil seal 18. Outer envelope surface 22 is coated with a multilayer optical interference filter 24 comprising a plurality of alternating layers of high and low index of refraction layers over which is disposed a light-scattering coating 26 according to the invention. The coating comprises a glassy, silica binder material 32 containing light-scattering particles 30. A portion of the fused quartz substrate 12 coated with the multilayer optical interference filter 24 over which is disposed the light-scattering coating 26 of the invention is shown in FIG. 1(*b*) at the detail at 28. The detail illustrated in FIG. 1(*b*) is meant to be only for purposes of illustration and not a detail of the coating over any particular filter. H and L represent alternating layers of high and low index of refraction materials, respectively. The detail in FIG. 1(*b*) is not intended to be drawn to scale. The invention is not limited to this particular embodiment of a lamp comprising a fused quartz envelope having a filament as the light source hermetically sealed within with a multilayer optical interference filter disposed on the outer surface of the lamp envelope on top of which is disposed a light-scattering coating according to the invention. Other lamps, lamp types and lamp configurations can also be used in accordance with the invention such as the double-ended quartz lamps having a lamp envelope fabricated from high temperature glass or fused quartz wherein the filament or arc chamber is elliptical in shape in order to more efficiently reflect infrared radiation emitted by the light source back to the light source as is disclosed, for example, in U.S. Pat. No. 5,019,743. Further, as stated above, the combination of multilayer optical interference filter and light-scattering coating may be employed on one or more surfaces of a light-transparent or light-transmissive reflector such as the all-glass reflector coated with an optical interference film disclosed in U.S. Pat. No. 5,143,445. In yet another embodiment, the lamp may be surrounded by a light-transparent or light-transmissive shroud (such as a glass or fused quartz shroud) surrounding the lamp and spaced apart from same with the filter and light-diffusing coating disposed on a surface of the shroud.

Multilayer optical interference filters also known as thin film optical interference filters which comprise alternating layers of two or more materials of different refractive index and their use with lamps, reflectors and lenses are known to those skilled in the art. These filters are used to selectively reflect and/or transmit light radiation from various portions of the electromagnetic spectrum such as ultraviolet, visible and infrared radiation. These filters are used in the lamp industry, as stated, on reflectors, lenses and lamp envelopes. These filters have been found to be particularly useful in improving the illumination efficacy or efficiency primarily of incandescent lamps by reflecting infrared radiation emitted by the filament (or arc) back to the filament (or arc) while transmitting the visible portion of the electromagnetic spectrum emitted by the light source, thereby reducing the amount of electrical energy required to be supplied to the filament to maintain its operating temperature. In the embodiment disclosed above, lamps were made wherein the multilayer optical interference filter reflected the infrared radiation emitted by the filament back to the filament and, at the same time, transmitted all of the light in the visible portion of the electromagnetic spectrum (e.g., 400–750 nm). Multilayer optical interference filters used in the lamp industry for applications where the filter will be exposed to high temperatures in excess of 500° C. or so are made of alternating layers of refractory metal oxides such as tantala (tantalum pentoxide), titania (titanium dioxide), niobia (niobium pentoxide) and silica ($SiO_2$) wherein the silica is the low refractive index material and the tantala, titania or niobia is the high refractive index material. Such filters and lamps and reflectors employing same are disclosed, for example, in U.S. Pat. Nos. 5,143,445; 5,138,219; 4,588,923; and 4,663,557 as illustrative, but non-limiting examples. These multilayer filters are applied using evaporation or sputtering techniques, dip-coating into organic precursors and also by chemical vapor deposition (CVD) and low pressure chemical vapor deposition (LPCVD) processes. In actual lamps made according to the invention of the type disclosed in FIG. 1, multilayer optical interference filters for reflecting the infrared radiation emitted by the filament back to the filament and at the same time transmitting visible light radiation were made of alternating layers of tantala and silica applied to the outer surface of the fused quartz lamp envelope by LPCVD as disclosed in U.S. Pat. No. 4,949,005 (the disclosures of which are incorporated herein by reference) having a total of 26–30 layers and some with over 40 layers as disclosed, for example, in U.S. Pat. Nos. 5,143,445 and 5,138,219. However, it should be understood that the invention is not limited to the use of such a filter which only transmits visible light radiation and reflects infrared radiation. Such filters can also be designed for changing the color emitted by the lamp. In the embodiment where the filter is to reflect infrared radiation back to the filament, it is essential that the filter be disposed around the filament in a configuration that will insure its efficient use as an infrared reflector. This means that the substrate to which the filter is applied must be as smooth as practicable and must be applied in a geometric configuration to insure that the infrared radiation-emitting source is at the optical center of the filter configuration. In the embodiment illustrated in FIG. 1 the filter is applied to the outer surface 22 of the lamp envelope 12 enclosing the filament 14 within wherein envelope 12 is in the form of a hollow cylinder. That is, lamp 10 is a linear lamp of tubular shape. Furthermore, to the extent possible filament 14 must be precisely radially aligned so that the longitudinal axis of the filament is coincident with the longitudinal axis of the optical center of the interior filament cavity or chamber of lamp 10. Filament alignment is achieved by employing suitable filament supports 15 which can be in the form of a tungsten or other refractory metal wire coil. Other filament or arc chamber shapes coated with an infrared reflecting filter which have been employed to insure reflection of the emitted infrared radiation back to the light source include spherical and elliptical shapes.

As set forth above, the light-scattering coating employed in the practice of the invention comprises a vitreous or glassy silica binder containing light-scattering particles. Light-scattering particles useful in the coating of the invention include any material transparent to visible light having an index of refraction different from that of the silica binder and which is electrically non-conductive, chemically inert with respect to the filter and binder material and not adversely affected by the operating temperature of the lamp, the radiation emitted by the lamp or the ambient in which the lamp is operating. Illustrative, but non-limiting examples of light-scattering particulate materials useful with the coating of the invention and which meet these requirements include $Al_2O_3$, BN, $Y_2O_3$, $ZrO_2$, SiC, $Ta_2O_5$, $TiO_2$, $Si_3N_4$, and $Nb_2O_5$. In order to efficiently scatter light across the entire visible spectrum, the light-scattering particles should have an effective, or agglomerated, physical cross-section ("effective diameter") of at least one-quarter the wavelength of red light (i.e., 180 nm). Some particles smaller than this may be included in the distribution, but they participate very little as optical scatterers. The lower limit in preferred particle size is thus set by the ability of individual particles to effectively scatter (about 0.2 microns). The upper limit lies between 0.5–3 microns and is influenced by the amount of oversize particles and their effective diameter as is explained below. Alumina particles primarily ranging in size from 0.2 to 0.4 micron have worked satisfactorily in the practice of the invention.

As set forth above, the binder for the light-scattering coating useful in the practice of the invention is a glassy silica which is derived from a coating precursor comprising a liquid dispersion of colloidal silica in a silicone. Silicone is used herein in its generic sense. Coatings have been made wherein the silicone is a water-alcohol solution of the partial condensate of R(SI(OH) 3) wherein R is an alkane, such as methyl trimethoxy silane. Examples of suitable silicones of this type, including some which are disclosed as containing colloidal silica are disclosed, for example, in U.S. Pat. Nos. 3,986,997; 4,275,118; 4,500,669 and 4,571,365, the disclosures of which are incorporated hereby by reference. Coatings made from these materials are able to withstand the high temperatures, often in excess of 900° C., reached by the surface of the lamp envelope of a high intensity filament or arc discharge lamp after the coating precursor has been converted to a glassy silaceous material by burning out the organic material. After the liquid coating precursor of the invention comprising light-scattering particles dispersed in a silicone solution in which is dispersed colloidal silica has been applied over an interference filter on a lamp envelope and dried at a low temperature to evaporate the solvents, the precursor coated lamp is slowly heated in air to an elevated temperature to pyrolyze the organic matter and form a glassy coating of the invention comprising light-scattering particles dispersed in a silica matrix or binder. A temperature of 350° C. has been found sufficient to pyrolyze the organics out of the coating and form the glassy silica binder. Densification and sintering of the so-formed silica is achieved by energizing the lamp. The temperature of the fused quartz lamp envelope reaches 900° C. and the coating is fully densified within the first hour of lamp operation. Silica is used here in a generic sense in that some silicates may also be present. Thus, the light scattering coating of the invention comprises a glassy, silica binder containing lighting scattering particles. The invention will be further understood with reference to the examples below.

EXAMPLES

Linear incandescent lamps according to the invention were made as illustrated in FIG. 1 having a tubular quartz envelope 10 millimeters in diameter, 105 millimeters long and operated at 120 volt and 650 watts. These lamps were coated with multilayer optical interference filters for reflecting infrared radiation and transmitting visible light radiation having a 24 layer design (tantala/silica) of the type disclosed in U.S. Pat. No. 5,143,445 and also a 46 layer design of the type disclosed in U.S. Pat. No. 5,138,219 employing the LPCVD process disclosed in these patents. These lamps were coated with a precursor coating according to the invention containing 2 parts by weight of a Degussa C fumed alumina powder in 15 parts by weight of a thermosetting silicone solution. The silicone solution was made by adding 70 cc butanol and 70 cc isopropanol to 60 cc of a Silvue 313 Abrasion Resistant Coating obtained from SDC Coatings, Inc., of Garden Grove, Calif. The Silvue 313 is a dispersion of colloidal silica in a solution of a partial condensate of $R(Si(OH)_3)$ wherein R is a methyl group. This dispersion contains 5% acetic acid, 13% n-butanol, 30% isopropanol 1% methanol (all wt. %), and water. The total solids content of the colloidal silica and methyl trimethoxy silane in the Silvue 313 ranges between 20–25% wt. %. The Degussa C alumina was stirred into the silicone solution, followed by placing the alumina containing solution in an ultrasonic bath. The Degussa C has a primary particle size of 10 mm and a useful or agglomerated particle size having an effective diameter ranging between roughly 200–500 mm or 0.2–0.5 micron. Lamps were dipped in this precursor coating mixture and air dried for at least five minutes. The dried, coated lamps were then placed in a laboratory oven at 350° C. for thirty minutes to drive off or pyrolyze the organic material and begin densification of the silica. After this treatment the lamps may be energized or lit at full rated voltage without darkening or blackening of the coating. Since the lamp envelope can reach temperatures in excess of 900° C., the coating continues to densify during the first hour of use. The coating of the invention, which is a glassy silica binder containing light scattering particles (in this case alumina), is formed after the 350° C. heat treatment and the silica binder merely continues to densify up to the theoretical limit of silica at higher temperatures.

Lamps receiving this treatment were energized and burned for over 2000 hours with no noticeable degradation of the coating or diminution of the diffused light-emitting properties of the lamp. The light scattering or diffusing coating generally had excellent adhesion to lamps having filters of alternating layers of tantala and silica. However, the adhesion of the light-scattering or diffusion coating can vary depending on the surface condition of the filter (i.e., surface cracking and roughness of the filter). Accordingly, a precoat or primer that was found to provide adequate adhesion of the light-diffusing coating to the filter without adversely affecting the optical properties was a mixture of the Alon C alumina powder and boric acid in about a 3 to 1 weight ratio to which was added methanol and Cellosolve acetate. The precoat was also applied by dipping. The precoat or primer required less than thirty minutes to dry. The lamps were then coated with the light-scattering coating of the invention which was a mixture of the silicone solution and Degussa C referred to above. These lamps also had excellent optical properties in that the lamps emitted diffuse light and the coating adhesion was excellent. All the lamps made with the light-scattering coating containing Degussa C alumina had specular transmissions less than 15% and total transmission (specular plus diffuse or scattered light) greater than 50%.

Visual observations and experimental measurements have shown that the appearance and optical performance of sandblasted quartz can be simulated if the diffuse coating has a specular transmittance less than 15%. Diffuse reflection of visible light back into the lamp is undesirable since some of this light is lost due to internal absorption on leads or the filament. This means total transmittance (specular plus diffuse forward light) should be as high as possible—at least 50%. FIG. 2 shows the effect of coating thickness of the coating of the invention on transmittance for two different particle size distributions. In these examples the weight concentration of particles in the final coating was held constant. The Degussa alumina powder consists of particles primarily ranging from 0.2 to 0.4 micron in effective particle size or diameter. Specular transmittances below 15% were readily achieved over a wide range of coating thickness while maintaining high total transmittance greater than 50%. Coatings between 4 and 10 microns thick had acceptable performance and acceptable visual appearance. The Baikowski CR30 alumina powder consisted of larger particles than the Degussa. About 35% of the particles were smaller than 1 micron, 80% of the particles were smaller than 3 microns, and 20% of the particles were between 3 and 8 microns. The larger particles resulted in excessive scattering. The desired properties of <15% specular transmittance and >50% total transmittance could be achieved only at a coating thickness of less than 4 microns. At this film thickness, the CR30 coating had incomplete coverage of particles on the filter surface. Although the transmittance targets could be met over a narrow range of film thicknesses, the resulting coating was sufficiently spotty or grainy to be aesthetically unacceptable in appearance.

It is understood that various other embodiments and modifications of the practice of the invention will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A light-transmissive article having at least one surface with at least a portion of said surface having a multilayer optical interference filter with a light-scattering coating comprising light-scattering particles in a vitreous substantially pure, silica binder disposed adjacent said filter.

2. An article of claim 1 wherein the refractive index of said light-scattering particles is greater than the refractive index of said binder.

3. An article of claim 2 wherein said light-scattering particles are transparent to visible light radiation.

4. An article of claim 3 wherein the effective particle size of said light-scattering particles does not exceed 3 microns.

5. An article of claim 3 wherein said filter reflects infrared radiation and transmits visible light.

6. An article of claim 4 wherein said filter reflects infrared radiation and transmits visible light radiation.

7. An article of claim 6 wherein said filter is made of alternating layers of refractory metal oxide.

8. An article of claim 7 wherein said light-scattering particles comprise alumina.

9. A lamp comprising a light-transmissive envelope enclosing a source of IR and visible light radiation with a multilayer optical interference filter disposed adjacent said envelope which transmits visible light and a light-scattering coating comprising light-scattering particles in a vitreous substantially pure, silica binder disposed adjacent said filter.

10. A lamp according to claim 9 wherein said light-scattering particles have a refractive index different from the refractive index of said silica binder.

11. A lamp according to claim 10 wherein said light-scattering particles are transparent to visible light.

12. A lamp according to claim 11 wherein said filter is made of alternating layers ot refractory metal oxide.

13. A lamp according to claim 12 wherein said light-scattering particles have an effective particle diameter no greater than 3 microns.

14. A lamp according to claim 13 wherein said filter reflects IR.

15. A lamp according to claim 14 wherein said light source is a filament.

16. A lamp according to claim 14 wherein said light source is an arc discharge.

17. A lamp according to claim 14 wherein said light-scattering particles comprise alumina.

18. A lamp comprising a light-transmissive, vitreous envelope enclosing a source of IR and visible light radiation with a multilayer optical interference filter disposed adjacent said envelope which transmits visible light and with a light-scattering coating comprising light-scattering particles in a vitreous substantially pure, silica binder disposed adjacent said filter, wherein said coating is formed by dispersing particles of light-scattering material in a dispersion of colloidal silica in a liquid silicone solution which is disposed adjacent said filter and heated at elevated temperature to drive out the organic component of said silicone and convert said silicone and said colloidal silica to a vitreous, silica binder.

* * * * *